US007673884B2

(12) United States Patent
Wuerthner

(10) Patent No.: US 7,673,884 B2
(45) Date of Patent: Mar. 9, 2010

(54) SKATING SPORTS DEVICE WITH A DETACHABLY MOUNTED EXCHANGEABLE BLADE

(75) Inventor: Holger Wuerthner, Villingen-Schwenningen (DE)

(73) Assignee: Onyx-Systems Patentmanagement GmbH, Villingen-Schwenningen (DE)

( * ) Notice: Subject to any disclaimer, the term of this patent is extended or adjusted under 35 U.S.C. 154(b) by 61 days.

(21) Appl. No.: 11/883,327

(22) PCT Filed: Jan. 5, 2006

(86) PCT No.: PCT/EP2006/000044

§ 371 (c)(1),
(2), (4) Date: Jul. 30, 2007

(87) PCT Pub. No.: WO2006/081907

PCT Pub. Date: Aug. 10, 2006

(65) Prior Publication Data

US 2008/0150242 A1 Jun. 26, 2008

(30) Foreign Application Priority Data

Jan. 31, 2005 (DE) ..... 10 2005 004 515

(51) Int. Cl.
*A63C 1/30* (2006.01)
*A63C 3/00* (2006.01)
*A63C 1/00* (2006.01)

(52) U.S. Cl. ..... 280/11.18; 280/7.13; 280/7.14; 280/11.12; 280/11.19; 280/11.207; 280/841; 280/609; 280/610

(58) Field of Classification Search ..... 280/11.18, 280/11.12, 11.19, 841, 11.207, 7.13, 7.14, 280/11.17, 609, 610
See application file for complete search history.

(56) References Cited

U.S. PATENT DOCUMENTS

| | | | | | |
|---|---|---|---|---|---|
| 1,275,519 | A | * | 8/1918 | Becker | 280/11.17 |
| 1,904,270 | A | * | 4/1933 | Charette | 280/11.17 |
| 1,944,409 | A | * | 1/1934 | Deyhle | 280/11.14 |
| 2,868,553 | A | * | 1/1959 | Rieckman | 280/7.13 |
| 3,212,786 | A | * | 10/1965 | Schmitt et al. | 280/11.12 |
| 4,074,909 | A | * | 2/1978 | Baikie | 280/11.12 |
| 4,131,288 | A | * | 12/1978 | Wilson | 280/11.17 |
| 4,139,209 | A | * | 2/1979 | Humphreys | 280/11.12 |
| 4,218,069 | A | * | 8/1980 | Baikie | 280/11.12 |

(Continued)

FOREIGN PATENT DOCUMENTS

| | | |
|---|---|---|
| AT | 153261 | 12/1937 |

(Continued)

*Primary Examiner*—Glenn Dayoan
*Assistant Examiner*—Jacob Meyer
(74) *Attorney, Agent, or Firm*—The Nath Law Group; Derek Richmond; Robert T. Burns

(57) ABSTRACT

The invention relates to a skating sports device, in particular skating boot, comprising an exchangeable blade holder (14), connected to a boot by means of sole and heel plates (4 and 5). An exchangeable blade (1) may be clipped in the exchangeable blade holder (14), which is held under tension in the front and rear region by locking clip buttons (2) which may be operated without tools. A torsion duplex cross (3), formed by torsion and flexion bars (3*a* and 3*b*) absorbs the torsion and flexional forces occurring during skating and neutralizes the same.

20 Claims, 6 Drawing Sheets

U.S. PATENT DOCUMENTS

| | | | | | |
|---|---|---|---|---|---|
| 4,379,563 | A * | 4/1983 | Arsenault | 280/7.1 |
| 4,382,615 | A * | 5/1983 | Gronborg et al. | 280/825 |
| 4,744,574 | A * | 5/1988 | Soo | 280/11.18 |
| 4,932,675 | A * | 6/1990 | Olson et al. | 280/7.13 |
| 5,088,749 | A * | 2/1992 | Olivieri | 280/11.18 |
| 5,137,290 | A * | 8/1992 | Patterson et al. | 280/11.12 |
| 5,332,242 | A * | 7/1994 | Cann et al. | 280/11.18 |
| 5,383,674 | A * | 1/1995 | Cann et al. | 280/11.18 |
| 5,388,845 | A * | 2/1995 | Soo | 280/11.17 |
| 5,484,148 | A * | 1/1996 | Olivieri | 280/11.18 |
| 5,524,912 | A * | 6/1996 | Laub et al. | 280/7.13 |
| 5,615,901 | A * | 4/1997 | Piotrowski | 280/7.14 |
| 5,641,169 | A * | 6/1997 | Bekessy | 280/11.18 |
| 5,662,338 | A * | 9/1997 | Steinhauser, Jr. | 280/7.14 |
| 5,769,434 | A * | 6/1998 | Wurthner | 280/11.18 |
| 5,810,368 | A * | 9/1998 | Steinhauser, Jr. | 280/7.14 |
| 5,839,734 | A * | 11/1998 | Steinhauser, Jr. | 280/7.13 |
| 5,845,927 | A * | 12/1998 | Steinhauser, Jr. | 280/7.14 |
| 5,890,723 | A | 4/1999 | Benoit | |
| 6,039,328 | A * | 3/2000 | Pawlowski et al. | 280/7.13 |
| 6,065,758 | A * | 5/2000 | Steinhauser, Jr. | 280/7.14 |
| 6,105,975 | A * | 8/2000 | Shum | 280/7.13 |
| 6,109,622 | A * | 8/2000 | Reynolds | 280/11.17 |
| 6,217,035 | B1 * | 4/2001 | Steinhauser, Jr. | 280/7.14 |
| 6,364,321 | B1 * | 4/2002 | Steinhauser, Jr. | 280/11.18 |
| 6,419,241 | B1 * | 7/2002 | Chenevert | 280/11.18 |
| 6,460,864 | B1 * | 10/2002 | Shieh | 280/11.19 |
| 6,467,778 | B1 * | 10/2002 | Goldsmith et al. | 280/11.12 |
| 6,485,033 | B2 * | 11/2002 | Nicoletti et al. | 280/11.18 |
| 6,523,835 | B1 * | 2/2003 | Lyden | 280/11.12 |
| 6,623,017 | B1 * | 9/2003 | Steinhauser, Jr. | 280/11.18 |
| 6,695,322 | B2 * | 2/2004 | Goldsmith et al. | 280/11.12 |
| 6,761,363 | B2 * | 7/2004 | Fask et al. | 280/11.18 |
| 6,932,361 | B2 * | 8/2005 | Steinhauser, Jr. | 280/11.18 |
| 7,243,924 | B2 * | 7/2007 | Dahlo et al. | 280/11.18 |
| 7,387,302 | B2 * | 6/2008 | Goldsmith et al. | 280/11.12 |
| 7,523,947 | B2 * | 4/2009 | Pham et al. | 280/11.12 |
| 2002/0014750 | A1 * | 2/2002 | Benoit | 280/11.221 |
| 2002/0140186 | A1 * | 10/2002 | Nicoletti et al. | 280/11.18 |
| 2002/0175481 | A1 | 11/2002 | Steinhauser, Jr. | |
| 2008/0001369 | A1 * | 1/2008 | Wylie et al. | 280/11.12 |

FOREIGN PATENT DOCUMENTS

| | | |
|---|---|---|
| DE | 31 04 483 | 8/1986 |
| DE | 42 33 880 | 1/1994 |
| DE | 690 10 153 | 10/1994 |
| JP | 2004223210 | 8/2004 |

* cited by examiner

SKATING SPORTS DEVICE WITH A DETACHABLY MOUNTED EXCHANGEABLE BLADE

BACKGROUND OF THE INVENTION

The invention relates to a skating sports, device having an exchangeable blade holder which may be detachably fastened to a base element.

Skating sports devices, namely ice skates, having exchangeable steel blades are known from various publications, for example EP 0 427 920 B1, U.S. Pat. No. 5,641,169, and AT 143 261.

For stability reasons these designs require a relatively stable running blade, namely, one composed exclusively of steel.

These designs are less suited for a skating sports device having a blade composed of a base element made of plastic, for example, and a composite running blade which is exchangeably fastened thereto, as is known in DE 42 33 880 C1.

Ice skates designed according to this concept have become established in practice.

In these ice skates, the composite running blade is connected to the base element by means of screws distributed over the length of the skate.

BRIEF SUMMARY OF THE INVENTION

The object of the present invention is to improve and simplify replacement of the exchangeable blade without impairing the torsional and flexional strength and without increasing the weight.

This object is achieved according to the present invention by use of a skating sports device having the features of claim 1, according to which the base element has an exchangeable blade holder which has at least two pairs of locking clip buttons in the front and rear regions for detachable fastening and locking of the exchangeable blade.

The V-shaped design of the exchangeable blade holder, i.e., adaptation of the exchangeable blade holder to the exchangeable blade, stated in claim 2 also results in high stability, even for small wall thicknesses.

The additional approaches according to claims 3 through 6 result in further improvement of stability without impairing the replaceability of the exchangeable blade without using tools, and without increasing the weight.

The approach according to the invention is particularly suitable for ice skates in which a boot is connected to the base element supporting the exchangeable blade.

claims 7, 8, and 9 provide particularly advantageous measures for improving the stability and the running dynamic characteristics.

To protect the running surfaces and in particular the sharp blade edges, a blade protector known as such from DE 31 04 483 C2 is provided in claims 10 through 12, which, however, is adapted to the special design of the skating sports device according to the invention.

Further embodiments of the skating sports device, which are especially suitable for commercial applications, are the subject matter of claims 13 through 16.

The subject matter of the invention is explained in detail below with reference to one particularly preferred exemplary embodiment illustrated in the drawings, which show the following:

BRIEF DESCRIPTION OF THE DRAWINGS

FIG. 6: shows a side view of the blade with the blade protector mounted.

DETAILED DESCRIPTION

Figure 1:
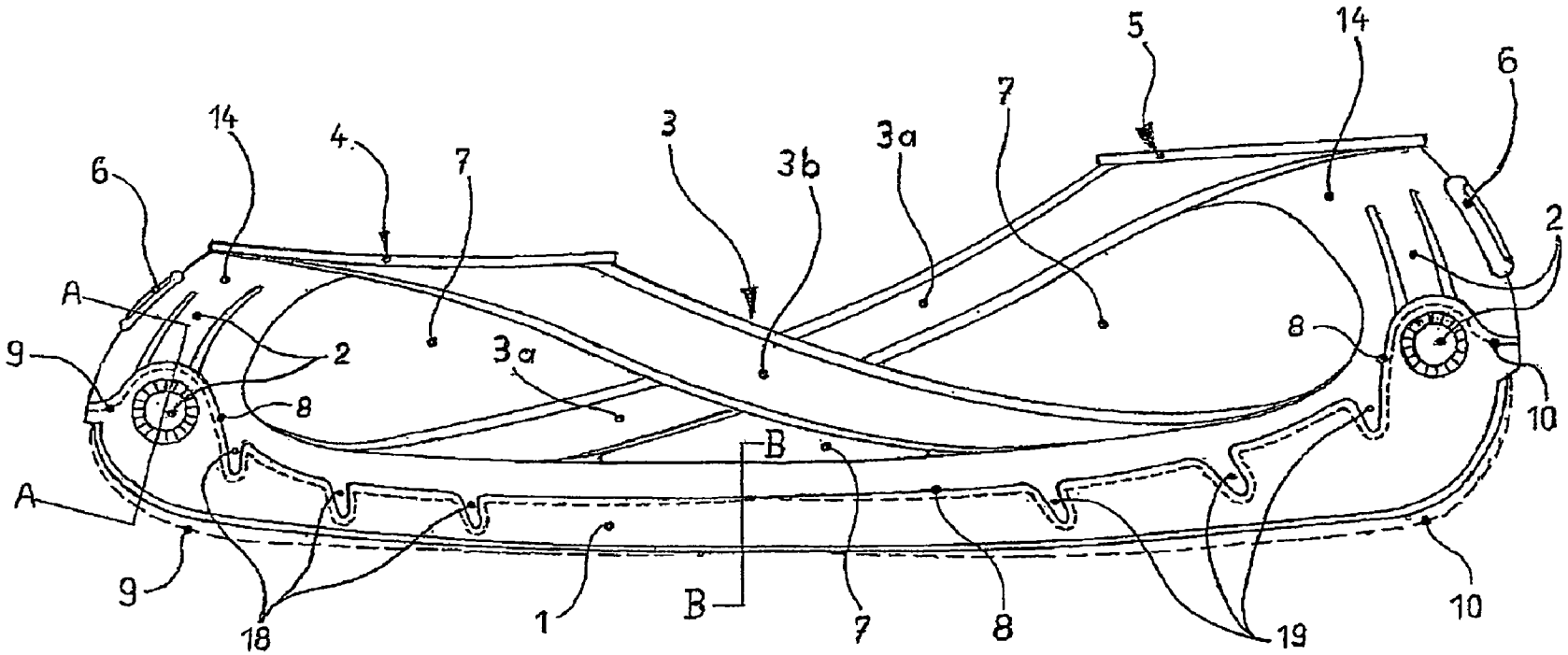
FIG. 1: shows a side view of an ice skate blade having an exchangeable blade.

The drawings illustrate a blade designed according to the invention which may be fastened to a boot (not illustrated) by means of the blade holder-sole plate 4 and the blade holder-heel plate 5.

The blade has a V-shaped exchangeable blade holder 14, symmetrical to the centerline, made of plastic or another extrudable material. The composite component provided as the exchangeable blade 1 is fastened to the exchangeable blade holder 14. As described in detail in DE 42 33 880 C1, the exchangeable blade has a support 1*a*, made of plastic or similar material, in the underside of which the steel runner 1*b* is embedded.

In its front and rear regions the exchangeable blade 1 has locking holes 17 on both sides, in which locking clip buttons 2 provided on both sides and integrated into the exchangeable blade holder engage.

Figure 3:
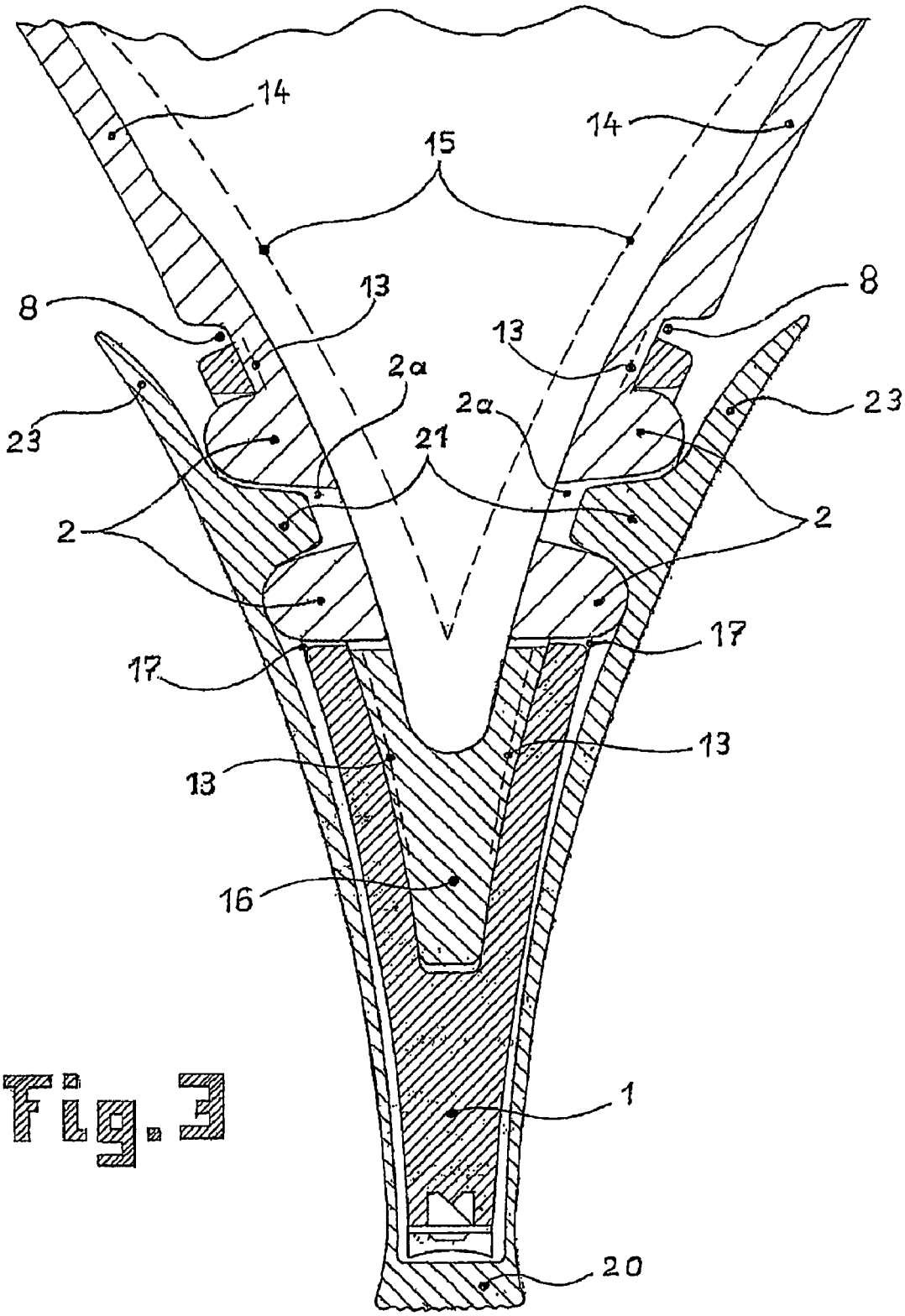
FIG. 3: shows an enlarged partial section along line A-A of FIG. 1, with a blade protector mounted.
Figure 4:
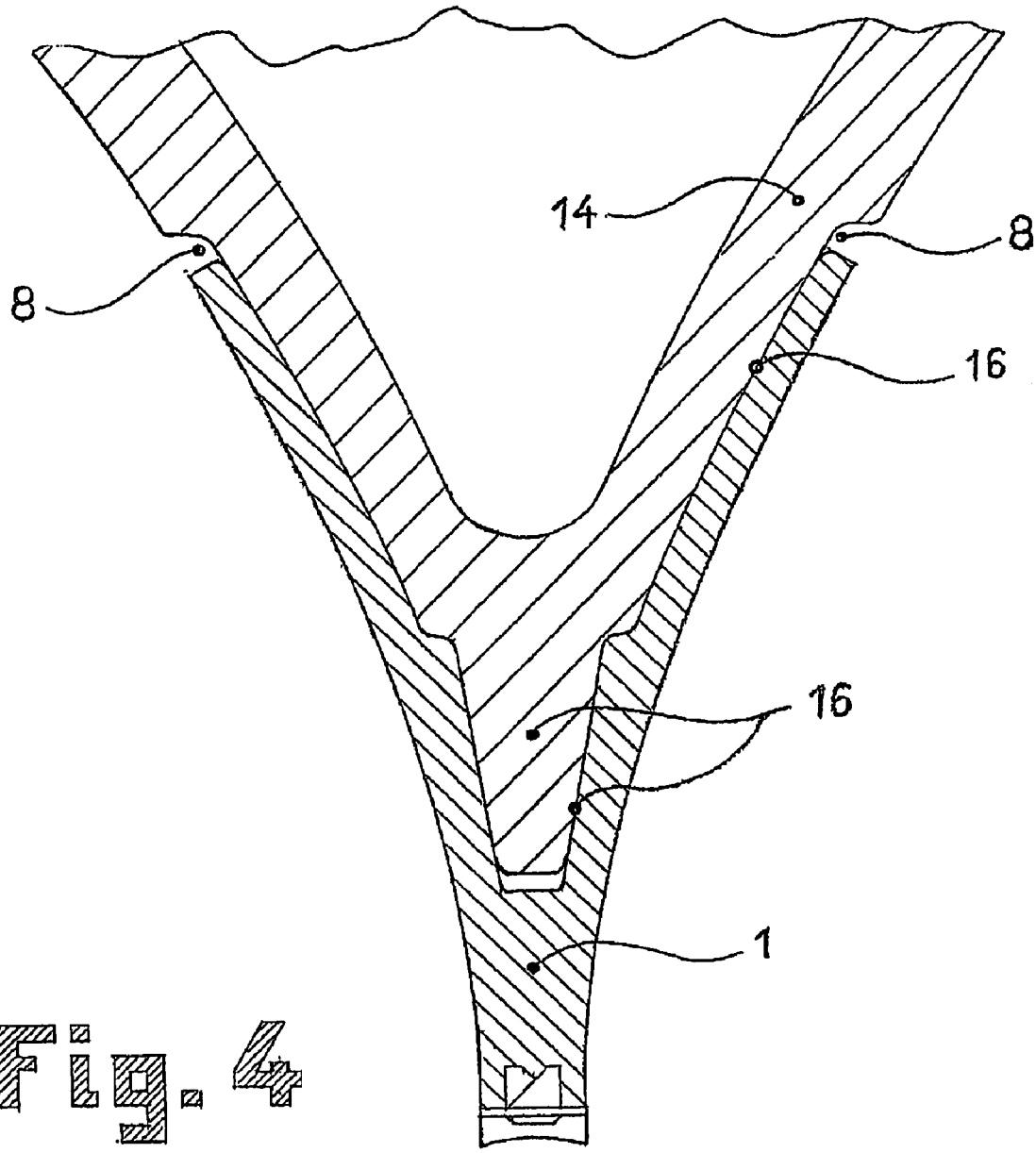
FIG. 4: shows an enlarged section along line B-B of FIG. 1.
Figure 5:
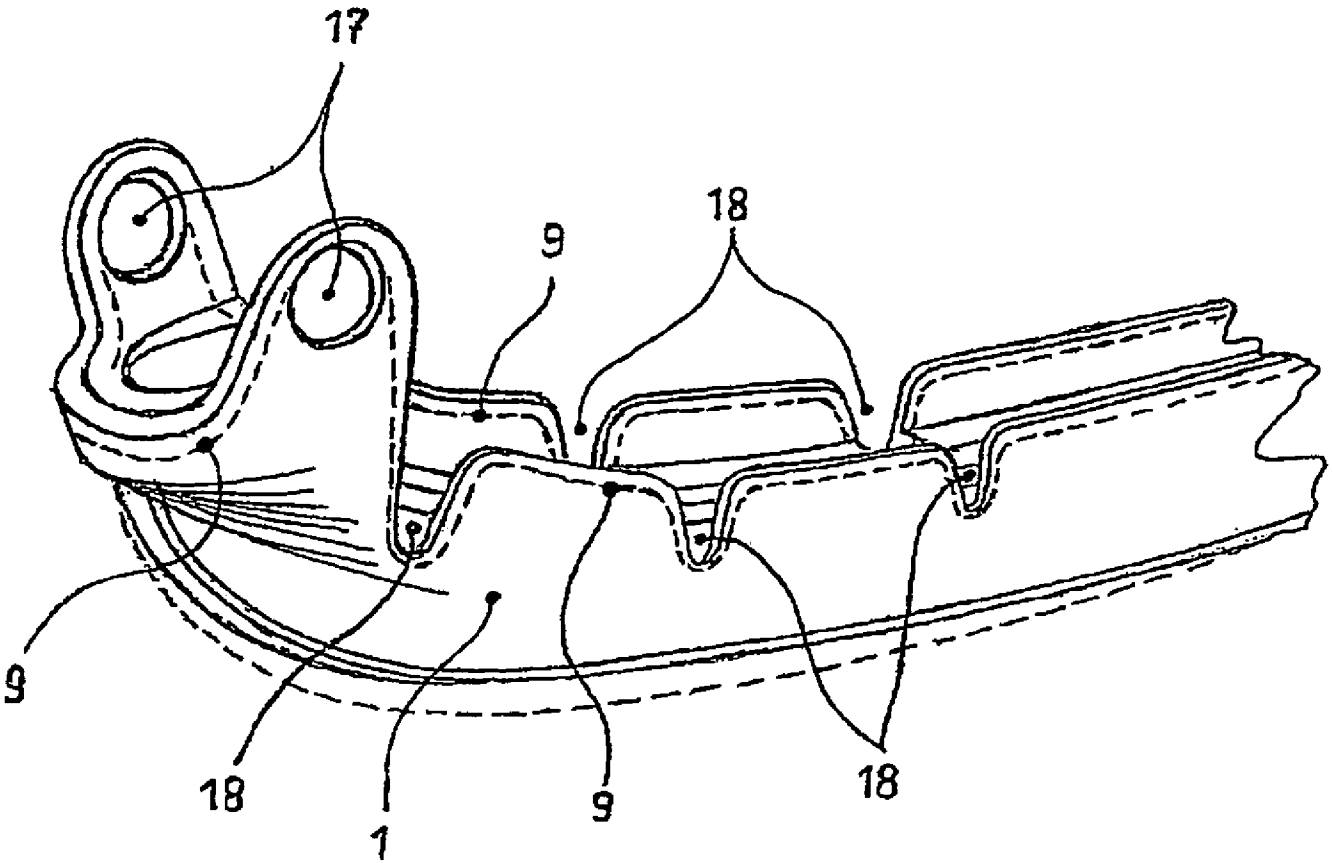
FIG. 5: shows an enlarged perspective partial illustration of the exchangeable blade in the front region.
Figure 5:
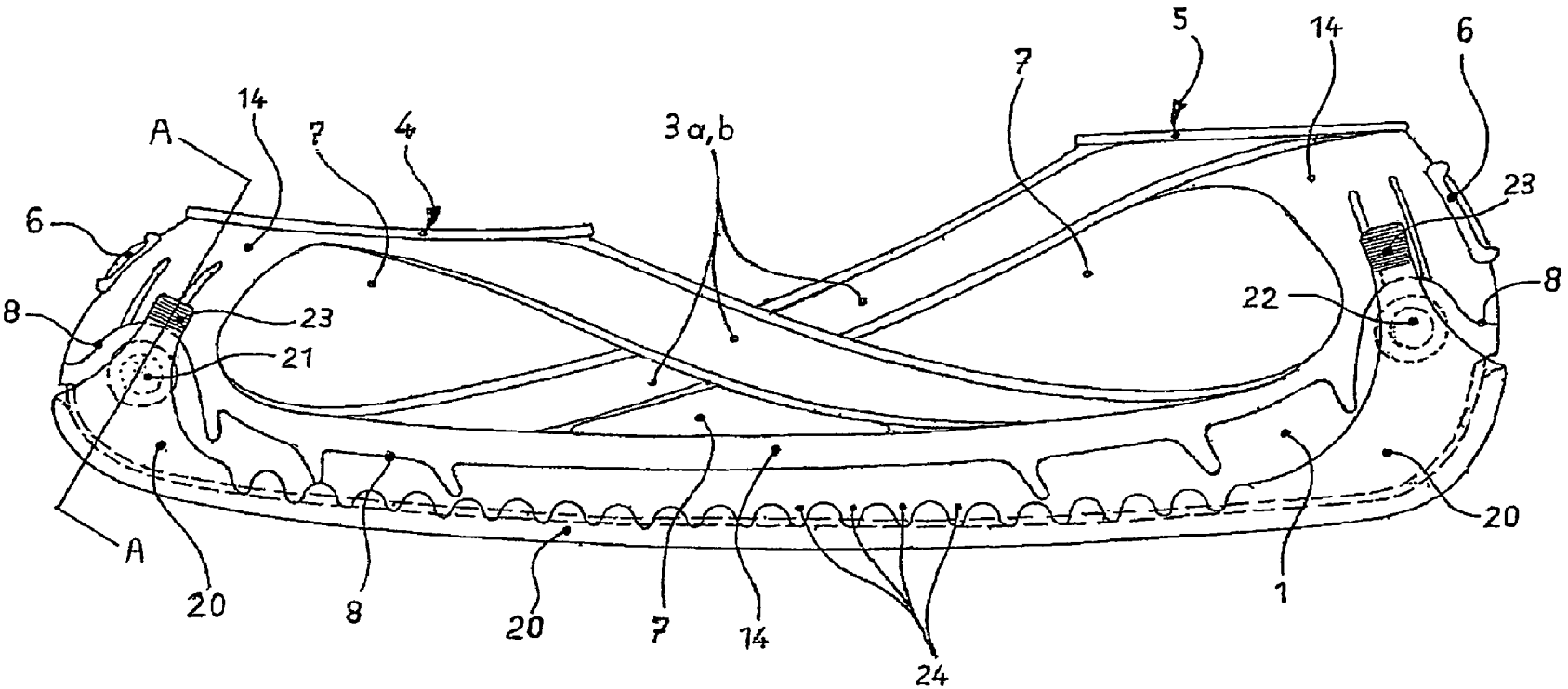

To ensure a play-free locking of the exchangeable blade 1 on the exchangeable blade holder 14 having the locking clip buttons 2, in the region of its locking holes 17 the exchangeable blade 1 is pretensioned against the interior of the holder, as indicated by the dotted line 13 in FIG. 3.

For fastening the exchangeable blade 1 to the exchangeable blade holder 14, first the locking clip buttons 2 located in the rear region are engaged in the corresponding locking holes 17, whereupon the exchangeable blade is swiveled in the clockwise direction in FIG. 1 toward the front region of the exchangeable blade holder 14, and the exchangeable blade 1 is pushed upward over the rear pretensioning line 10 and the front pretensioning line 9 until the locking clip buttons 2 provided in the front region and on both sides on the exchangeable blade holder 14 engage in the corresponding locking holes 17.

In the disengaged state the exchangeable blade 1 is pretensioned so that in the front and rear regions it has a reverse curvature corresponding to the two pretensioning lines 9 and 10. After the locking clip buttons 2 engage in the front and rear locking holes 17, the exchangeable blade 1 together with the shape and stabilization strip 16 integrated into the exchangeable blade holder 14, which absorbs transverse forces and is used for centering, is fixed in its final position on the exchangeable blade holder 14 in a force-fit manner.

As a result of the reverse curvature of the exchangeable blade 1 which creates the pretensioning, a constant, vertically directed tension is maintained over the entire length of the exchangeable blade 1, particularly in the region of the front and rear locking clip buttons 2, which ensures a play-free and force-fit seating of the exchangeable blade 1 on the exchangeable blade holder 14.

On its lower end the exchangeable blade holder 14 has a recess 8 which corresponds to the wall thickness of the tongues of the exchangeable blade 1 situated thereabove, so that the exchangeable blade 1 is in flush alignment with the exchangeable blade holder 14.

As shown in the drawings, in the front and rear regions the exchangeable blade 1 has slots 18 and 19 which prevent the outer walls of the exchangeable blade 1 from being deformed upon contact with the exchangeable blade holder 14, i.e., upon a change in the pretensioning lines 9 and 10.

To remove the exchangeable blade 1, the front and rear locking clip buttons 2 are pressed toward one another and inward until they are pushed from the locking holes 17 into the position indicated by reference numeral 15 in FIG. 3, whereupon the exchangeable blade 1 as a result of its pretensioning springs back into the position indicated by pretensioning lines 9 and 10 in FIG. 1. The exchangeable blade 1 may then be removed from the exchangeable blade holder 14 without expenditure of force. A new exchangeable blade 1 is inserted in the reverse sequence.

The described locking clip technique is also suitable when conventional solid steel blades are used.

In this case the steel blade is provided with tongues having locking holes which are molded, glued, or welded on, whereby instead of the molded strip the solid steel blade 16 is inserted into a slot located in the exchangeable blade holder 14.

The specialized design of the exchangeable blade 1 according to the invention allows minimal wall thicknesses, since the thin-walled, flexible tongues provided on both sides in the front and rear, in which the locking holes 17 are located, provide sufficient rigidity for the wall. These tongues are pretensioned in such a way that they assume the position indicated by reference numeral 13 before the exchangeable blade is pushed onto the exchangeable blade holder 14, i.e., in the unspread state. This pretensioning ensures a play-free seating as well as optimal contour adjustment of the locking clip buttons 2 and the locking holes 17.

The shape and stabilization strip 16, which is integrated into the exchangeable blade holder 14 and is deeply embedded in the slot provided in the exchangeable blade 1, provides the necessary stability for the extremely thin-walled and thus light exchangeable blade 1.

This design of the exchangeable blade allows problem-free, simple, and extremely rapid replacement of the exchangeable blade without mechanical aids.

The specialized V-shaped contour in conjunction with the shape and stabilization strip 16 integrated into the exchangeable blade holder 14 ensures an extremely effective and load-carrying connection between the exchangeable blade 1 and the exchangeable blade holder 14 with a comparatively low weight. The locking clip buttons 2 provided in the front and rear regions which cooperate with the locking holes 17 allow worn blades to be quickly exchanged with new blades in less than ten seconds with little application of force. In addition, manufacture of a system having this composite blade is simple and economical.

Time-consuming blade grinding and expensive service and maintenance operations which can be performed only by costly specialists using expensive grinding equipment may be dispensed with.

For normal blade wear, blade grinding performed by a specialist in the conventional manner, using relatively costly grinding equipment, requires approximately 15 times the amount of labor for blades of poor quality.

Figure 2:
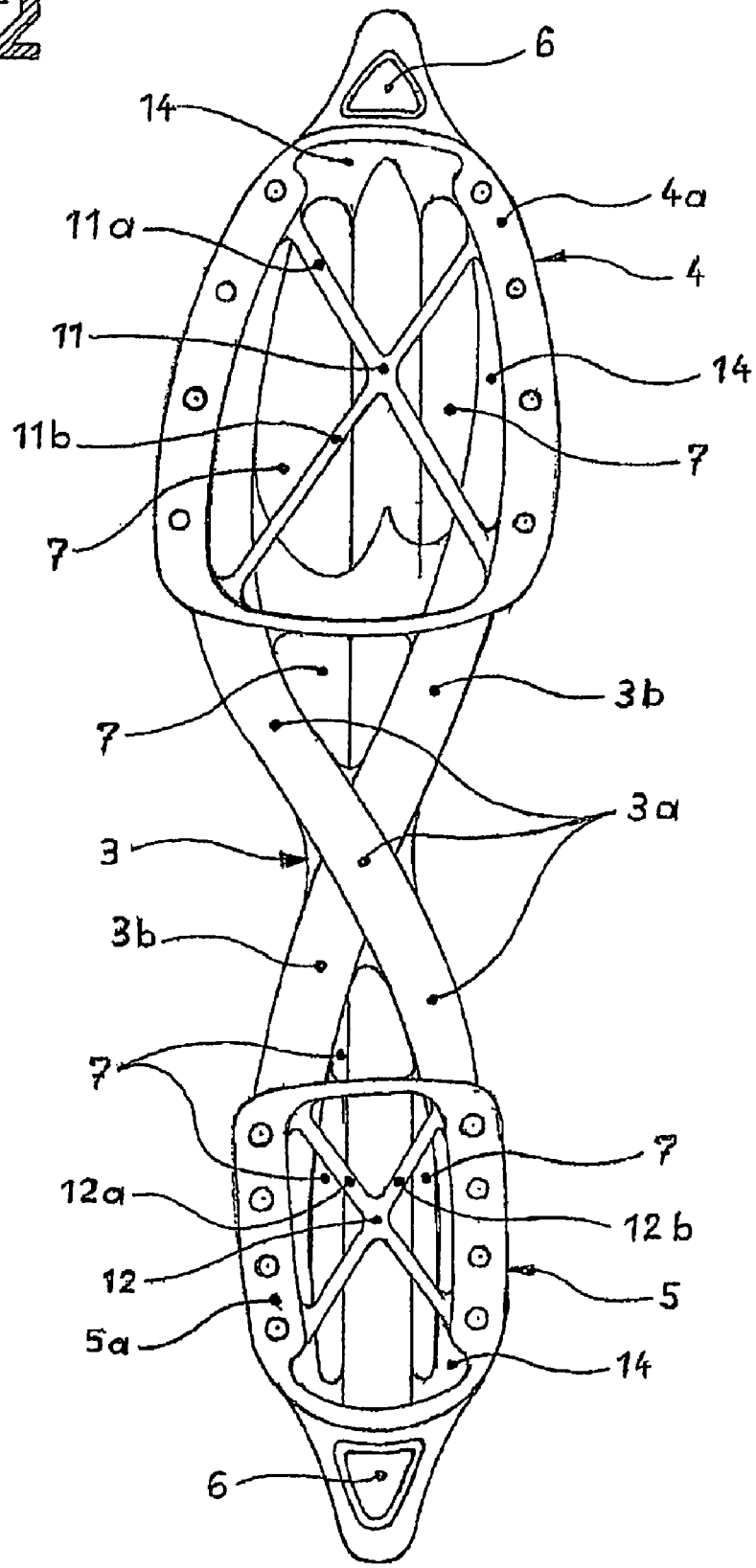
FIG. 2: shows a top view of the blade according to FIG. 1.

As clearly shown in FIGS. 1, 2, and 6, the blade holder-sole plate 4 and the blade holder-heel plate 5 are connected to the rear and front regions of the exchangeable blade holder 14 via diagonal, mutually inclined and intersecting torsion and flexion bars 3*a* and 3*b*. It is further shown that the torsion and flexion bars 3*a*, 3*b* connect the edge regions of the blade holder-sole plate 4 and of the blade holder-heel plate 5 to the respectively opposite edge region of the exchangeable blade holder 14, forming a torsion duplex cross 3. This torsion duplex cross 3 is used for reducing the torsional and flexional forces which occur in the exchangeable blade 1 and the exchangeable blade holder 14 during use. In this manner the torsional and flexional forces created by the effect of running dynamics between the blade holder-sole plate 4 and the blade holder-heel plate 5 are absorbed and largely neutralized.

When the front region of the exchangeable blade 1 is subjected to internal transverse stresses, the resulting torsional and flexional forces between the front, internally located locking hole 17 via the clipped-in locking clip buttons 2 and the internal holder-sole plate 4, and via the shape and stabilization strip 16 running linearly in the exchangeable blade holder 14 are diagonally transmitted via the torsion duplex cross 3 to the external locking hole 17 in the heel region and the clipped-in locking clip button 2, and to the external heel plate 5.

According to the same principle, for internal transverse stresses the transverse and flexional forces occurring in the internal heel region are diagonally transmitted via the torsion duplex cross 3 to the external front region of the blade.

Thus, the transverse and vertical forces arising at the interior of the blade holder-sole plate 4 during acceleration are diagonally transmitted via the torsion duplex cross 3 to the exterior of the blade holder-heel plate 5. Conversely, when extremely tight curves, for example, are traveled, the above-referenced forces from the exterior of the blade holder-heel plate 5 are in turn diagonally transmitted via the torsion duplex cross 3 to the interior of the blade holder-sole plate 4.

Openings 7 are provided between the torsion duplex cross 3 and the exchangeable blade holder 14 which result in reduced weight without loss of stability.

The design of the blade holder-sole plate 4 and heel plate 4 and 5, respectively, shown in FIG. 2 provide further improvement in the stability, and thus result in improved absorption of torsional and flexional forces.

These plates each comprise a closed ring 4*a* and 5*a* in which spokes 11*a*, 11*b* and 12*a*, 12*b* which run diagonally and intersect at the centerpoint are provided for forming a torsional cross 11 and 12, respectively.

In addition, forces which act vertically on the exchangeable blade 1 are absorbed and largely neutralized by the torsion and flexion bars 3*a*, 3*b*.

The inventive design of the base element comprising the exchangeable blade 14, blade holder sole and heel plates 4 and 5, and torsion duplex cross 3 allows an extremely light, filigreed, and material-saving design with above-average torsional and flexional rigidity of the exchangeable blade holder 14.

The torsion duplex cross 3 for the exchangeable blade 14 together with a riveted, screwed, glued, or molded-on boot ensures a straight-line course of the exchangeable blade 1 which does not lose its shape even under high transverse stresses.

This design using the torsion duplex cross and the shape and stabilization strip running in the longitudinal direction ensures, particularly in the acceleration phase, above-average torsional and flexional strength of the blade system.

On account of the torsional and flexional strength achieved by the torsion duplex cross, exchangeable blade holders 14 having comparatively small wall thicknesses may be used, resulting in reduced weight and also lower manufacturing costs and therefore a lower sales price.

To protect the running surface and in particular the blades of the runner 1*b*, and to allow safe walking when off the ice, as shown in FIGS. 3 and 6 a blade protector 20 which completely covers the exchangeable blade 1 may be mounted on the exchangeable blade holder 14. At its front and rear ends the blade protector has mutually facing pins 21 and 22 which engage in the openings 2*a* for the annularly shaped locking clip buttons 2 which clip into the locking holes 17. At the upper edge of the blade protector 20 are provided unlocking latches 23, associated with the locking pins 21 and 22, by means of which the pins 21 and 22 may be pushed outward against the elastic action of the blade protector 20 made of elastic material, until the pins 21 and 22 disengage from the recesses 2*a*, allowing the blade protector 20 to be removed. The side walls of the blade protector 20, which has a U-shaped cross section, are provided with slots 24 distributed over their length, thereby increasing the flexibility of the blade protector 20 and allowing it to be adapted precisely to the contour of the exchangeable blade holder 14 and the exchangeable blade 1, and to engage therewith.

For this exact fit, the blade protector 20 may be made of a light, extremely flexible material which is secure during walking, preferably plastic.

The exchangeable blade holder 14 is designed in such a way that in its front and rear regions a clip 6 containing lighting means or a transmitter for wireless transmission of data identifying use may optionally be mounted, preferably locked in place.

A light-emitting diode (LED) which may optionally emit multicolored blinking light is particularly suited as the lighting means.

This lighting means may be placed in operation by means of a motion switch, for example as a result of the vibrations during skating, and after a fairly long time may be automatically turned off to the neutral position of the sports device by means of a delay off-switch.

When ice skates designed according to the invention are used commercially, i.e., for skate rental, instead of or in addition to the lighting means a transmitter may be provided by means of which the user data, which essentially is information for identifying the skate and for determining the operating and cost data, may be transmitted.

LIST OF REFERENCE NUMERALS

1 Exchangeable blade
1*a* Support
1*b* Runner
2 Locking clip button
2*a* Recess
3 Torsion duplex cross
3*a* Torsion and flexion bars
3*b* Torsion and flexion bars
4 Blade holder-sole plate
4*a* Ring
5 Blade holder-heel plate
5*a* Ring
6 Clip for light-emitting diodes or transmitters
7 Blade holder opening
8 Recess for exchangeable blade 1
9 Front pretensioning line for exchangeable blade
10 Rear pretensioning line for exchangeable blade
11 Inner sole plate torsional cross
11*a* Spokes
11*b* Spokes
12 Inner heel plate torsional cross
12*a* Spokes
12*b* Spokes
13 Position of the unspread tongues of the exchangeable blade 1
14 Exchangeable blade holder
15 Position of the pressed-in locking clip buttons 2
16 Shape and stabilization strip
17 Locking holes
18 Slots in the exchangeable blade
19 Rear slots in the exchangeable blade
20 Blade protector
21 Front pins
22 Rear pins
23 Unlocking latches
24 Slots

The invention claimed is:

1. Skating sports device having an exchangeable blade that is detachably mounted on a base element, characterized in that the base element has an exchangeable blade holder (14) having elastically deformable walls and at least two pairs of locking clip buttons (2) in the front and rear regions for detachable fastening and locking of the exchangeable blade (1), with the at least two locking clip buttons (2) integrated into the elastically deformable walls of the exchangeable blade holder (14).

2. Skating sports device according to claim 1, characterized in that the exchangeable blade holder (14) has a V-shaped cross section, and the exchangeable blade (1) has a V-shaped receptacle corresponding to the exchangeable blade cross section, and the exchangeable blade holder preferably is made of plastic or another extrudable material.

3. Skating sports device having an exchangeable blade that is detachably mounted on a base element, characterized in that the base element has an exchangeable blade holder (14) which has at least two pairs of locking clip buttons (2) in the front and rear regions for detachable fastening and locking of the exchangeable blade (1) and; wherein the locking clip buttons (2) are integrated into elastically deformable walls of the exchangeable blade holder (14), and corresponding locking holes (17) in the exchangeable blade (1) elastically clip into same.

4. Skating sports device according to claim 3, characterized in that the locking clip buttons (2) are integrated into the elastically deformable walls of the exchangeable blade holder (14), and corresponding locking holes (17) in the exchangeable blade (1) elastically clip into same.

5. Skating sports device according to claim 3, characterized in that the exchangeable blade (1) has a reverse curvature (9, 10) deviates deviating from exchangeable blade holder (14) curvature in such a way that the clipped-in exchangeable blade (1) is braced against the exchangeable blade holder (14).

6. Skating sports device having an exchangeable blade that is detachably mounted on a base element, characterized in that the base element has an exchangeable blade holder (14) which has at least two pairs of locking clip buttons (2) in the front and rear regions for detachable fastening and locking of the exchangeable blade (1) and; wherein the exchangeable blade (1) has a reverse curvature (9, 10) which deviates from the curvature of the exchangeable blade holder (14) in such a way that the clipped-in exchangeable blade (1) is braced against the exchangeable blade holder (14).

7. Skating sports device according to claim 6, characterized in that the exchangeable blade (1) preferably has vertical slots (18, 19) in the front and rear regions.

8. Skating sports device according to claim 1, characterized in that a shape and stabilization strip (16) running in the longitudinal direction is embedded in the exchangeable blade (1).

9. Skating sports device in the form of an ice skate, having a boot which is connected to a base element supporting an exchangeable blade, characterized in that the base element comprises a blade holder-sole plate (4) and a blade holder-heel plate (5) which are connected to rear and front regions of an exchangeable blade holder (14) via diagonal, mutually inclined and intersecting torsion and flexion bars (3*a*, 3*b*) for reducing torsional and flexional forces which occur in the exchangeable blade (1) and the exchangeable blade holder (14) during use.

10. Skating sports device according to claim 9, characterized in that the torsion and flexion bars (3*a*, 3*b*) connect edge regions of the blade holder-sole plate (4) and of the blade holder-heel plate (5) to a respective opposite edge region of the exchangeable blade holder (14), forming a torsion duplex cross (3).

11. Skating sports device according to claim 9, characterized in that the blade holder-sole plate (4) and the blade holder-heel plate (5) comprise a respective closed ring (4*a*, 5*a*) in which a torsional cross (11, 12) is provided having spokes (1l*a*, 11*b*; 12*a*, 12*b*) which run diagonally and intersect at a centerpoint.

12. Skating sports device according to claim 9, characterized by a blade protector (20) which covers the exchangeable blade (1) in a contoured, precise fit and which may be mounted on the exchangeable blade holder (14), and which has pins (21, 22) which may be engaged in recesses (2*a*) in locking clip buttons (2) of the exchangeable blade holder (14).

13. Skating sports device according to claim 12, characterized in that walls of the blade protector (20) comprise a U-shaped cross section and vertical slots (24).

14. Skating sports device according to claim 12, characterized in that the blade protector (20) comprises unlocking latches (23) in the vicinity of the pins (21, 22) which are lockable in locking holes (17) and elastically resilient material, at least in a region of the locking holes.

15. Skating sports device according to claim 9, characterized in that a lighting means and a lighting means clip (6) is inserted, preferably locked in place, in the front and/or rear region of the exchangeable blade holder (14).

16. Skating sports device according to claim 15, characterized in that the lighting means is a light-emitting diode (LED) which emits multicolored blinking light.

17. Skating sports device according to claim 15, characterized in that the lighting means is controlled by a motion switch and/or a delay off-switch.

18. Skating sports device according to claim 9, characterized in that a transmitter for wireless transmission of data identifying use is mounted, preferably locked in place, in a front or rear region of the exchangeable blade holder (14).

19. Skating sports device according to claim 10, characterized in that the blade holder-sole plate (4) and the blade holder-heel plate (5) comprise a respective closed ring (4*a*, 5*a*) in which a torsional cross (11, 12) is provided having spokes (11*a*, 11*b*; 12*a*, 12*b*) which run diagonally and intersect at a centerpoint.

20. Skating sports device according claim 17, characterized in that a transmitter for wireless transmission of data identifying use is mounted, preferably locked in place, in the front or rear region of the exchangeable blade holder (14).

* * * * *

UNITED STATES PATENT AND TRADEMARK OFFICE

CERTIFICATE OF CORRECTION

PATENT NO. : 7,673,884 B2
APPLICATION NO. : 11/883327
DATED : March 9, 2010
INVENTOR(S) : Holger Wuerthner It is certified that error appears in the above-identified patent and that said Letters Patent is hereby corrected as shown below:

Column 6, Line 49:

Please delete "...deviates..."

Signed and Sealed this

Fourth Day of May, 2010

David J. Kappos

David J. Kappos
*Director of the United States Patent and Trademark Office*